United States Patent [19]

Fujiwara et al.

[11] Patent Number: 4,963,079

[45] Date of Patent: Oct. 16, 1990

[54] SCREW FLUID MACHINE WITH HIGH EFFICIENCY BORE SHAPE

[75] Inventors: Mitsuru Fujiwara, Ibaraki; Akira Suzuki, Atsugi; Riichi Uchida, Ibaraki, all of Japan

[73] Assignee: Hitachi, Ltd., Tokyo, Japan

[21] Appl. No.: 111,614

[22] Filed: Oct. 23, 1987

[30] Foreign Application Priority Data

Oct. 24, 1986 [JP] Japan ..... 61-253246

[51] Int. Cl.[5] ..... F01C 1/16; F01C 19/00; F01C 21/10; F04C 18/16

[52] U.S. Cl. ..... 418/83; 418/194; 418/201.3

[58] Field of Search ..... 418/83, 150, 201, 194, 418/201.R, 201.B, 126; 74/458, 459, 424.5

[56] References Cited

U.S. PATENT DOCUMENTS

| | | | |
|---|---|---|---|
| 612,304 | 10/1898 | Blazer | 418/201 |
| 1,164,546 | 12/1915 | Neuland | 418/194 |
| 1,287,268 | 12/1918 | Edwards | 418/201 |
| 2,843,094 | 7/1958 | Berck | 418/126 |
| 2,931,308 | 4/1960 | Luthi | 418/194 |
| 3,179,330 | 4/1965 | MacColl | 418/201 |
| 3,180,559 | 4/1965 | Boyd | 418/194 |
| 3,237,524 | 3/1966 | Nilsson et al. | 418/126 |
| 3,423,017 | 1/1969 | Schibbye | 418/201 |
| 3,773,444 | 11/1973 | Koch | 418/201 |
| 4,020,642 | 5/1977 | Haselden | 418/201 |
| 4,405,286 | 9/1983 | Studer | 418/194 X |
| 4,475,878 | 10/1984 | Kasuya | 418/201 |
| 4,522,576 | 6/1985 | Carre | 418/201 |
| 4,792,294 | 12/1988 | Mowli | 418/201 R |

FOREIGN PATENT DOCUMENTS

| | | | |
|---|---|---|---|
| 56-17559 | 4/1981 | Japan . | |
| 57-159989 | 10/1982 | Japan . | |
| 58-110889 | 7/1983 | Japan | 418/201 R |
| 60-173382 | 9/1985 | Japan | 418/83 |

*Primary Examiner*—John J. Vrablik

*Attorney, Agent, or Firm*—Antonelli, Terry, Stout & Kraus

[57] ABSTRACT

A screw fluid machine in which the distance between a point on each of bore walls and the axis of a male or female rotor decreases at a normal temperature in the vicinity of a high-pressure port as the point proceeds from the low-pressure side to the high-pressure side.

5 Claims, 8 Drawing Sheets

SCREW FLUID MACHINE WITH HIGH EFFICIENCY BORE SHAPE

BACKGROUND OF THE INVENTION

This invention relates to a twin screw fluid machine and, more particularly, to a screw fluid machine having a casing with a bore shape suitable for the realization of high efficiency.

Details of a fundamental structure of a screw fluid machine are disclosed in U.S. Pat. No. 3,423,017. Generally, in a fluid machine which pumps gas such as a compressor, expander, or vacuum pump, the temperature of the gas is high on the high-pressure side. For example, in the case of a nonlubricated screw compressor which compresses air at a compression ratio of 8, there is a possibility of the temperature of air on the highpressure side exceeding 300° C. during operation, thereby increasing the thermal expansion of the rotor. A type of machine, such as that disclosed in U.S. Pat. No. 4,475,878, is known, in which the rotor is tapered so that its outside diameter at the high pressure side is reduced relative to that at the low-pressure side. According to this related art, the inside diameter of the bore which accommodates the rotor is increased by preliminarily calculating the thermal expansion of the rotor which occurs during the operation of the machine.

In traditional theory, it is thought that the thermal deformation of the casing which accommodates the rotor is small because the casing is cooled by a water jacket and by radiation from the surface of the casing. However, it has been found by measuring the temperature distribution over the casing using sensors embedded in different portions of the casing that the temperatures of these portions greatly differ from each other.

FIG. 15 shows the distribution of temperatures of a casing along a cross section of the bore perpendicular to the axis thereof. In FIG. 15 are illustrated bore walls 81 and 82 which face male and female rotors respectively, theoretical axes 83 and 84 of the male and female rotors, a high-pressure-side fluid passage 85 (hereinafter referred to as "high-pressure port") formed at an intersection of the bore walls 81 and 82, and a peripheral direction distribution curve 86 of the temperature of the bore wall 81 on the side of the male rotor. This curve represents a bore wall temperature T at a point A by the length of a line segment AB defined on a straight line which passes through an axis 83 of the male rotor and the point A. As is understood from FIG. 15, the bore wall temperature T on the side of the male rotor is high in the vicinity of the high-pressure port 85 and becomes lower as an angle $\theta$ in this figure decreases.

FIG. 16 shows the distribution of the temperature of the bore wall in the direction of the axis of the bore in a plane which contains the axis of the rotor. In FIG. 16 are illustrated a low-pressure end surface 88 of the bore wall 81, a high-pressure end surface 89 of the bore wall 81, an axis 90 of a male rotor 91, and a straight line 92 which represents the distribution of the temperature of the bore wall 81 in the direction of the axis of the bore and which represents a bore wall temperature T at a point D by the length of a line segment DE defined on a straight line which is perpendicular to the axis 90. As can be understood from FIG. 16, the bore wall temperature T is high at the high-pressure side and is low at the low-pressure side.

The conventional bore wall 81 is formed in such a manner that the inside diameter is uniform relative to the axis 90 so as to form a truly round cross section of the bore. However, the bore wall 81 is deformed by a change in the temperature thereof during operation, as mentioned above, so that the shape of the bore 81 deviates from the round even in a plane perpendicular to the center axis of the bore.

This related art has been described with respect to the male rotor alone, but it goes without saying that these facts also apply with respect to the portion on the side of the female rotor.

FIG. 17 shows gaps between the bore wall and rotors in accordance With the related art. In FIG. 17 are illustrated lines 93 and 94 which indicate the outside diameters of the male and female rotors at an ordinary temperature, lines 95 and 96 which indicate the outside diameters of the male and female rotors when the rotors are thermally deformed during operation, lines 98 and 99 which indicate the inside diameters of the bore walls on the sides of the male and female rotors at the ordinary temperature, and lines 100 and 101 which indicate the inside diameters of the bore walls on the sides of the male and female rotors when the bore walls are thermally deformed during operation The inside-diameter lines 98 and 99 of the bores on the sides of the male and female rotors are circular at the ordinary temperature.

During operation, the bore walls 81 and 82 are thermally deformed in accordance with the temperature distribution indicated in FIG. 16, and each point on the inside-diameter lines of the bore walls 95 and 96 is displaced outward in the radial direction. Specifically, this displacement is large in the vicinity of the highpressure outlet 85. Since the rotor is a revolving body, the outside-diameter line of the rotor when thermally deformed forms a circle in a plane perpendicular to the axis thereof. Accordingly, as shown in FIG. 17, a gap h between the outside-diameter lines 95 and 96 of the male and female rotors and the inside-diameter lines 100 and 101 of the bore walls is maximum in the vicinity of the highpressure port 85.

The casing in accordance with the related art is formed in such a manner that the inside diameters of the bore walls 81 and 82, which form cylindrical surfaces, are increased by preliminarily calculating the thermal expansions of the rotors exhibited during operation. However, as described above, the inside-diameter lines of the bore walls 100 and 101 are not deformed uniformly, and, therefore, the gap h shown in FIG. 17 becomes nonuniform. A leak which occurs at the gap h flows from a groove of one of the rotors to the adjacent groove over the top of a lobe formed therebetween (refer to FIG. 1). If, as described above, the gap h is large on the highpressure side, the loss of power is very large because the difference between the pressures in adjacent grooves is large on the high-pressure side. That is, a large difference between the ends of the course of the leak causes a large amount of leak per unit time and, hence, a large energy loss due to the leak.

SUMMARY OF THE INVENTION

It is therefore an object of the present invention to provide a screw fluid machine which is free of above-described problems and in which bore walls of the casing exhibit substantially the same inside diameters at any portions when they are thermally deformed during operation.

To this end, the present invention provides in one of its aspects a screw fluid machine having male and female rotors adapted to rotate about two parallel axes while engaging with each other, and a casing having a pair of bore walls with a low-pressure port and a high-pressure port, the bore walls intersecting with each other and respectively accommodating the male and female rotors, wherein, in a plane perpendicular to the axes of the male and female rotors, the distance between a point on at least one of the bore walls and a corresponding one of the axes of the male and female rotors decreases at a normal temperature at least in the vicinity of the high-pressure port along a temperature distribution as the point proceeds from the low-pressure side to the high-pressure side.

The present invention provide in another of its aspects a screw fluid machine comprising male and female rotors adapted to rotate about two parallel axes while engaging with each other, and a casing having a pair of bore walls with a low-pressure port and a highpressure port, the bore walls intersecting with each other and respectively accommodating the male and female rotors, wherein, in a plane containing the axis of the male rotor on the male rotor side and in a plane containing the axis of the female rotor on the female rotor, the distance between a point on at least one of the bore walls and a corresponding one of the axes of the male and female rotors decreases at a normal temperature at least in the vicinity of the high-pressure port along a temperature distribution as the point proceeds from a low-pressure end surface of the at least one of the bore walls to a highpressure end surface of the same.

In accordance with the present invention, the gaps between the bore walls and the male and female rotors during operation can be reduced even in the vicinity of the high-pressure port, thereby minimizing the leakage loss. As a result, improvement in the efficiency and great deal of energy saving can be achieved.

That is, the bore walls, which have been formed at the normal temperature in consideration of thermal deformation, exhibit, during operation, truly or substantially round shapes in a plane perpendicular to the axes of the male and female rotors. The gaps between the bore walls and the male and female rotors in the vicinity of the high-pressure port are thereby reduced, enabling a reduction in the leakage loss.

BRIEF DESCRIPTION OF THE DRAWINGS

FIG. 1 is a longitudinal sectional view of the first embodiment on a plane perpendicular to the axial direction;

FIG. 2 is an illustration of gaps formed between rotors and bore walls of the fluid machine shown in FIG. 1;

FIG. 3 is a cross-sectional view taken along a line III—III of FIG. 2;

FIG. 5 is an illustration of the relationship between a rotor and a bore;

FIG. 6 is a cross-sectional view taken along a line VI—VI of FIG. 5;

FIG. 7 is a transverse sectional view of the screw vacuum pump;

FIG. 8 is a longitudinal sectional view of the screw vacuum pump;

FIG. 9 is a schematic front view of a male rotor of the screw vacuum pump;

FIG. 10 is a cross-sectional view taken along a line X—X of FIG. 9;

FIG. 11 is a longitudinal sectional view of a female rotor taken at the same axial position as that in FIG. 10;

FIG. 12 is a graph of the temperature distribution in a rotor during the operation of the screw vacuum pump;

FIG. 13 is a graph of the comparison between the rotor gaps in the screw vacuum pump at an ordinary temperature or during operation;

FIG. 15 is a diagram of the temperature distribution over a bore wall in a plane perpendicular to the axis of a rotor;

FIG. 16 is a diagram of the temperature distribution over the bore wall in a plane which contains the axis of a rotor; and FIG. 17 is an illustration of gaps formed between rotors and bore walls.

DESCRIPTION OF THE PREFERRED EMBODIMENTS

The present invention will be described below in detail with respect to the embodiment thereof in conjunction with the accompanying drawings.

Figure 1:
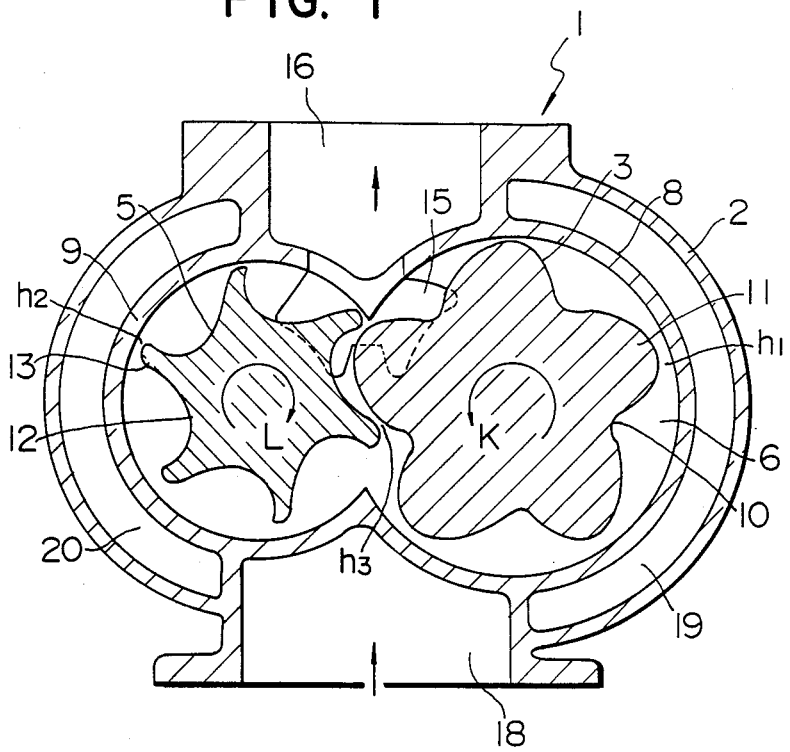
FIGS. 1 to 3 illustrate a screw fluid machine which represents a first embodiment of the present invention.
Figure 2:
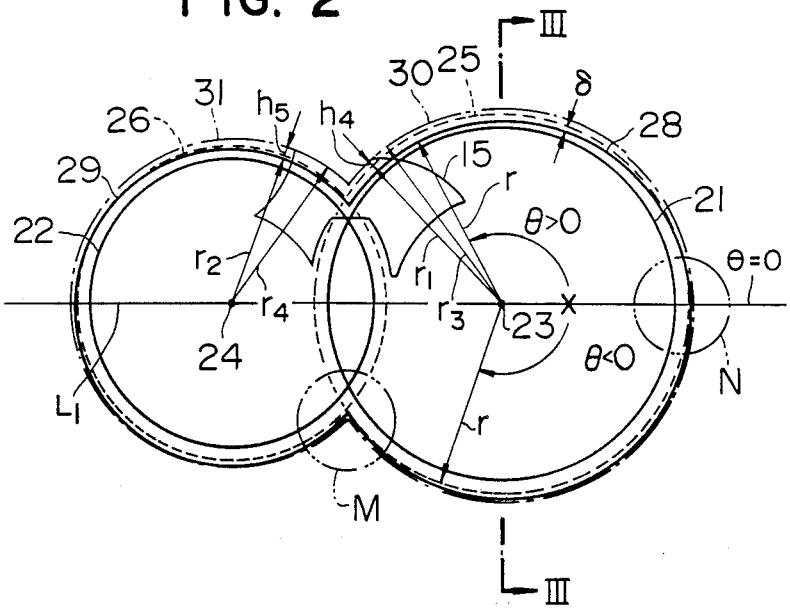
Figure 3:
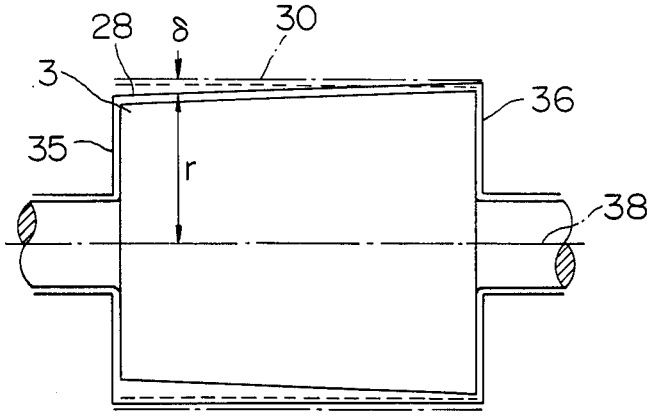

FIGS. 1 to 3 illustrate first embodiment of the present invention in which the present invention has been applied to a screw compressor. A screw compressor 1 has a casing 2, a male rotor 3 and a female rotor 5. A bore 6, which is a working space in which the male and female rotors 3 and 5 are accommodated, is formed in the casing 2. The wall of the bore 6 is separated into a male-rotorside bore wall 8 and a female-rotor-side bore wall 9 which have circular cross sections and which are parallel to each other.

The male rotor 3 and the female rotor 5, which are accommodated inside the bore walls 8 and 9, rotate about the centers of the bore walls 8 and 9 in the directions indicated by the arrows K and L, respectively. The male rotor 3 is a rotor having screw teeth which consist of five lobes 11 interposed between five grooves 10, and the female rotor 5 is a rotor having screw teeth which consist of six lobes 13 interposed between six grooves 12. The lobes 11 and 13 engage with each other at the position of intersection between the bore walls 8 and 9.

The casing 2 has an high-pressure port 15 which communicates with the bore at the position of intersection between the bore walls 8 and 9, a discharge chamber 16 which communicates with the high-pressure port 15, a suction chamber 18 into which gas is drawn from the outside and from which the gas is supplied inside the bore walls 8 and 9 through a low-pressure port (not shown), water jackets 19 and 20 which are adjacent to and extend along the bore walls 8 and 9 and which are adapted to cool the bore walls 8 and 9. The male and female rotors 3 and 5 compress the gas inside the bore 6 to a high pressure and supply the gas to a desired line through a discharge chamber 16.

FIG. 1 shows a state of the screw compressor 1 at an ordinary temperature. In FIG. 1, a gap $h_1$ between the top of the lobe 11 of the male rotor 3 and the bore wall 8, a gap $h_2$ betWeen the top of the lobe 13 of the female rotor 5 and the bore wall 9, and a gap $h_3$ between the male and female rotors 3 and 5 are magnified in order to make these gaps easy to see. These gaps are shown in the same manner in other drawings which will be referred to later. In the case of a lubricated compressor, the male and female rotors may be in contact with each other without forming the gap $h_3$ between the male and female rotors 3 and 5.

The shapes of the bore walls 8 and 9 will be described in detail with reference to FIG. 2 which is similar to FIG. 1 and which is a cross-sectional view on a plane perpendicular to the axis of the rotors of the screw compressor 1. FIG. 2 shows outside-diameter lines 21 and 22 of the male and female rotors 3 and 5 at the ordinary temperature, theoretical axes 23 and 24 of the male and female rotors 3 and 5, and outside-diameter lines 25 and 26 of the male and female rotors 3 and 5 which are exhibited when these rotors are thermally deformed during operation, and which are also circular as well as at the ordinary temperature.

In FIG. 2, polar coordinates are used to explain the shape of the bore. It is assumed that the origin of polar coordinates (r, $\theta$) corresponds to the theoretical axis of one of the rotors, and that a straight line which extends from the origin in the direction reverse to that of the axis of the other rotor is defined by $\theta=0$. The line L, passing through the centers 23, 24 of the rotors divides $\theta > 0$ from $\theta < 0$ on the side of the high-pressure port 15. Different coordinate systems are used for the male and female rotors 3 and 5, and the origins of these systems correspond to the axes 23 and 24, respectively. Only the coordinate system for the male rotor 3 is shown in FIG. 2, and the coordinate system for the female rotor 5 is omitted.

If the shapes of the lines which represent the contours of the bore walls 8 and 9, that is, the insidediameter lines 28 and 29 are selected as desired, it is possible to assume that the inside-diameter lines 30 and 31 of the bore walls 8 and 9 in the thermally deformed state during operation have radii $r_3$, $r_4$ which are longer than radii $r_1$, $r_2$ of the outside-diameter lines 25 and 26 exhibited during operation, by the lengths corresponding to gaps $h_4$ and $h_5$. These gaps $h_4$ and $h_5$ are radial gaps which are formed on the sides of the male and female rotors and which are necessary for the operation of these rotors. The values of these gaps $h_4$ and $h_5$ are selected in consideration of deflections of the rotors 3 and 5 during operation so that the rotors 3 and 5 do not contact the bore walls 8 and 9 during operation.

The difference between the shapes of the bore walls 8 and 9 at the normal temperature and at the temperature during operation can be calculated by a computer program of thermal deformation analysis using, e.g., a finite element method on the basis of the distributions of the temperatures of the casing 2 and the rotors 3 and 5 obtained experimentally or theoretically.

When the distribution of the temperature of the casing 2 is changed from the state at the normal temperature to the state at the high temperature during operation, a radial displacement $\delta$ of a point on the bore wall 8 becomes larger as the point approaches the high-pressure port 15. Accordingly, in the shape of the bore wall 8 at the normal temperature, the radius r becomes smaller as the angle $\theta$ becomes larger. However, the temperature in the vicinity of one of the points of intersection between the bore walls 8 and 9 opposite to the position of the high-pressure port 15, that is, in the vicinity of a portion M indicated in FIG. 2 may be higher than the temperature in the vicinity of a portion N due to a certain type of construction of the casing 2, so that the displacement in a thermal deformation in the vicinity of the portion M may become greater than that in the vicinity of the portion N. This is represented by a case in which the bore wall 8 is cooled by the water jacket 19, as shown in FIG. 1. In this case, as the angle $\theta$ becomes smaller within its negative region, the displacement $\delta$ becomes greater. However, a leak of gas considerably influences the performance of the compressor at least when the angle $\theta$ is in its positive region. The difference between the pressure of adjacent grooves is small at the portion of the bore wall that corresponds to the negative region of the angle $\theta$. In fact, thermal deformation of the casing 2 is small at this portion. Therefore, the consideration of the part of the above-described thermal deformation at the portion corresponding to the negative region of the angle $\theta$ does not contribute to improvement in the influence of thermal deformation upon the performance of the compressor.

FIG. 3 shows cross sections of the male rotor 3 and the bore wall 8 taken along the line III—III of FIG. 2. In FIG. 2, the shape of the bore wall exhibited at the normal temperature or at the time of operation is shown within a cross-sectional plane Which is perpendicular to the axes of rotors, but the displacement of the bore wall 8 during operation is not uniform in the axial direction. As shown in FIG. 3, the displacement $\delta$ of the insidediameter line 30 of the bore wall 8 during operation relative to the inside-diameter line 28 of the bore wall 8 at the normal temperature is greater at a position near a high-pressure end surface 35 and is smaller at a portion near a low-pressure end surface 36.

In the first embodiment of the present invention, as described above, the radius r of the bore wall 8 at the normal temperature is set to become smaller as it approaches the high-pressure end surface 35, so that the radius r is constant at different portions of the bore wall 8 during operation.

Next, the operation of the first embodiment of the present invention will be described.

At the normal temperature, the radius r of the inside-diameter line 28 of the bore wall becomes smaller at least in the vicinity of the high-pressure port 15 as the angle $\theta$ increases, as shown in FIG. 2, and it becomes smaller at least in the vicinity of the high-pressure port 15 as it proceeds from the low-pressure end surface 36 to the high-pressure end surface 35 as shown in FIG. 3. The shape of the bore wall 8 in a plane perpendicular to the axis 38 of the rotor 3 during operation thereby becomes truly or substantially round. As a result, the gap h between the bore wall 8 and the male rotor 3 can be maintained at a small width even in the vicinity of the high-pressure port 15, and there is no possibility of the gap h becoming undesirably large when the compressor operates. The leakage loss is thereby minimized, enabling improved efficiency and energy saving.

The present invention has been mainly described with respect to the male rotor only, but the same effects are, of course, possible on the side of the female rotor. In other embodiments which will be described below, the present invention will be mainly described with respect to the male rotor.

Figure 4:
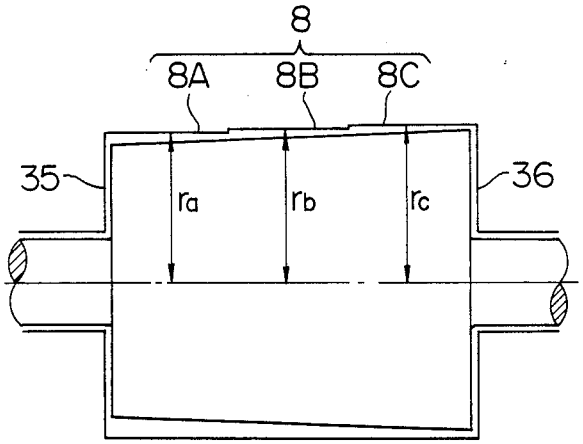
FIG. 4 is an illustration of the relationship between rotors and bore walls of a fluid machine which represents a second embodiment of the present invention.

FIG. 4 shows a second embodiment of the present invention in which the bore wall 8 is divided into, for example, three sections 8A, 8B and 8C between the highpressure and low-pressure end surfaces 35 and 36 in such a manner that bore radii ra, rb and rc in the divided sections are made constant within each section but are set to become larger successively starting from the high-pressure end surface 35 to the low-pressure end surface 36. The number of divided sections is not limited to three, and can be freely selected as desired. Also, it may be different from that of the bore wall on the side of the female rotor. If the bore wall 8 is divided in the axial direction and if the radius in each divided section is made constant, the bore wall 8 can be worked easily.

Figure 5:
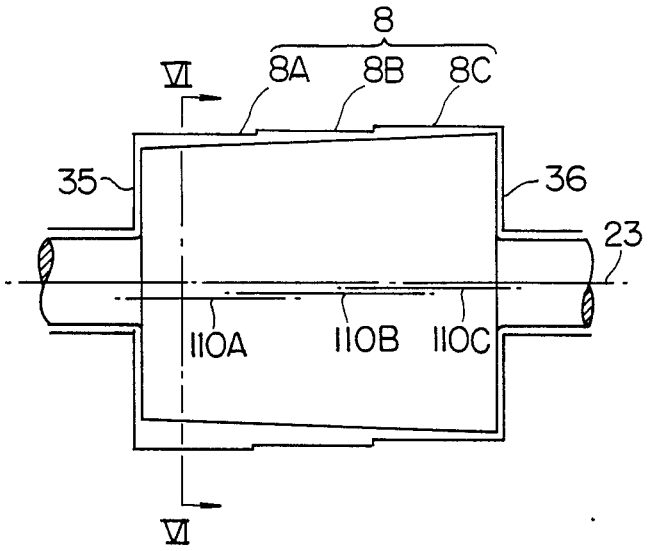
FIGS. 5 and 6 illustrate a third embodiment of the present invention.
Figure 6:
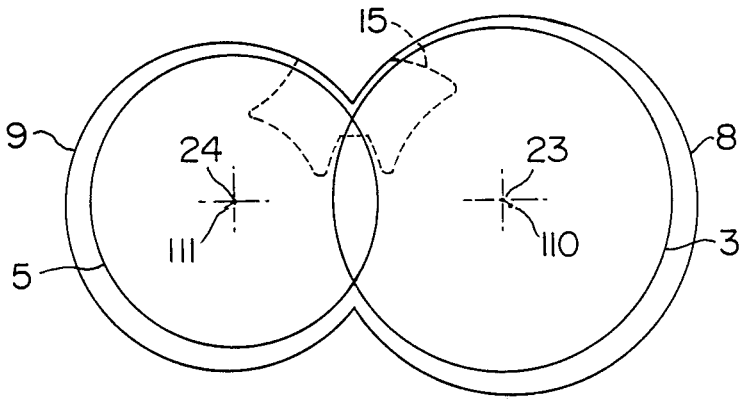

FIGS. 5 and 6 show a third embodiment of the present invention in which the bore wall 8 is divided into three sections between the high-pressure and low-pressure end surfaces 35 and 36 in a manner similar to that of the second embodiment. This embodiment differs from the second embodiment in that the centers 110, 111 of circles defined by the bore walls 8 and 9 deviate from the theoretical axes 23 and 24 of the male and female rotors 3 and 5 in the directions in which they become remoter from the highpressure port 15. One of the divided sections of each bore wall which is nearer to the high-pressure end surface 35 has a greater eccentricity.

To make the shape of the bore truly round when it is thermally deformed during operation, it is necessary to work the bore to provide thereon a complicated threedimensional curve at the normal temperature. If the bore shape is replaced with an approximate shape defined by eccentric circles, the bore can be easily worked without any substantial reduction in the effects of the original shape.

FIGS. 7 to 13 show a fourth embodiment of the present invention in which the present invention has been applied to rotors of a screw vacuum pump.

Figure 7:
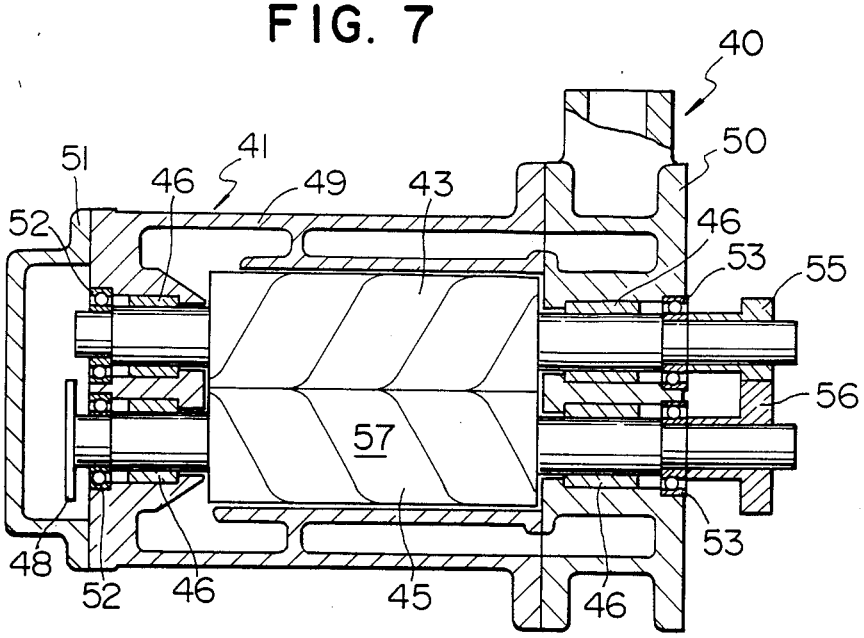
FIGS. 7 to 13 illustrate a screw vacuum pump which represents a fourth embodiment of the present invention.
Figure 8:
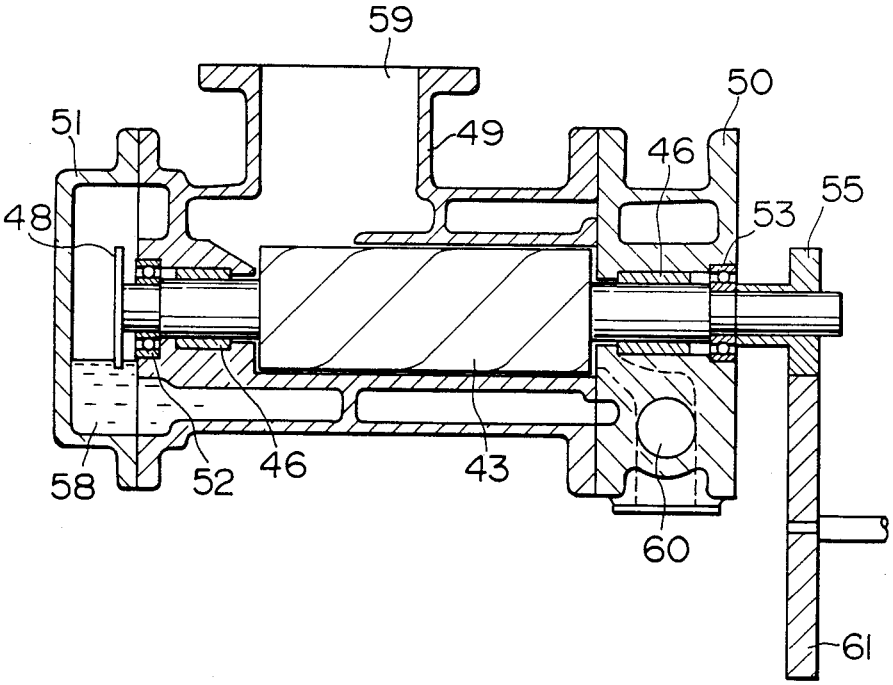

As shown in FIGS. 7 and 8, a screw vacuum pump 40 has a casing 41, a male rotor 43, a female rotor 45, bearing seal devices 46, and a slinger 48. The casing 41 consists of a main casing 49, discharge-side casing 50, and an end cover 51. The opposite ends of the male and female rotors 43 and 45 are rotatably supported by bearings 52 and 53. The male and female rotors 43 and 45 rotate while meshing with each other and maintaining a certain gap between them by a male and a female timing gears 55 and 56 attached to the ends of the rotors at the discharge side. A working chamber 57 is formed between the male and female rotors 43 and 45, the main casing 49, and the dischargeside casing 50.

The bearing seal devices 46 are adapted to enclose oil which is supplied to the bearings 52 and 53 and to the timing gears 55 and 56. The slinger 48 sends the oil in an oil sump 58 flying, thereby supplying oil to the bearings 52. The oil sump 58 is formed by the end cover 51 and a part of the main casing 49. A suction port 59 is formed in the main casing 49, and a discharge port 60 is formed in the discharge-side casing 50. The main timing gear 55 meshes with a full gear 61 which is directly connected to an electric motor (not shown).

Figure 9:
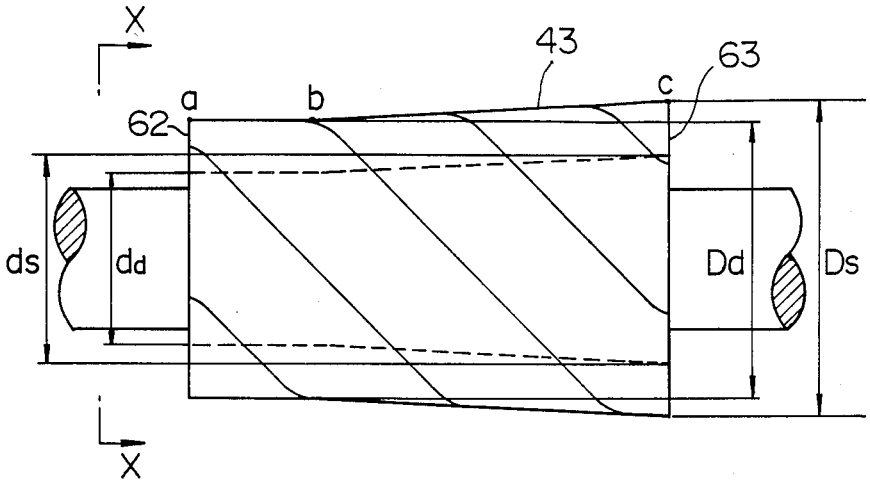
Figure 10:
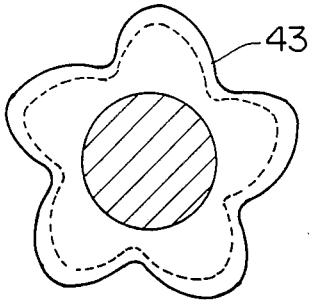

FIG. 9 shows the shape of the male rotor 43 at the normal temperature. In FIG. 9, Dd is the tip diameter at a discharge end 62, $d_d$ is the root diameter thereof, Ds is the tip diameter at a suction end 63, and ds is the root diameter thereof. The tip diameter and the root diameter of the portion between the points a and b are constant, and the portion between the points b and c is tapered so as to have a largest diameter at the suction end 63. FIG. 10 is a cross-sectional view taken along the line X—X of FIG. 9. In FIG. 10, the solid line indicates the shape of the male rotor 43 at the suction end 63, and the broken line indicates the shape of the male rotor 43 at the discharge end 62.

Figure 11:
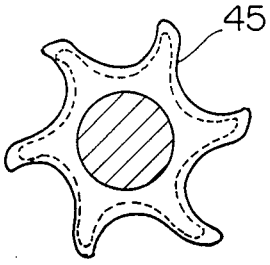

Similarly, the female rotor 45 is formed of a straight portion and a tapered portion separated in the axial direction with a boundary formed at the point b, FIG. 11 is a cross-sectional view of a female rotor taken at the same axial position as that in FIG. 10. In FIG. 11, the solid line indicates the shape of the female rotor 45 at the suction end 63, and the broken line indicates the shape of the female rotor 45 at the discharge end 62.

Next, the operation of the fourth embodiment of the present invention will be described. When the screw vacuum pump is driven by the electric motor, the male and female rotors rotate while engaging with each other so that gas at the suction side is drawn through the suction port 59 and is discharged through the discharge port 60.

Figure 12:
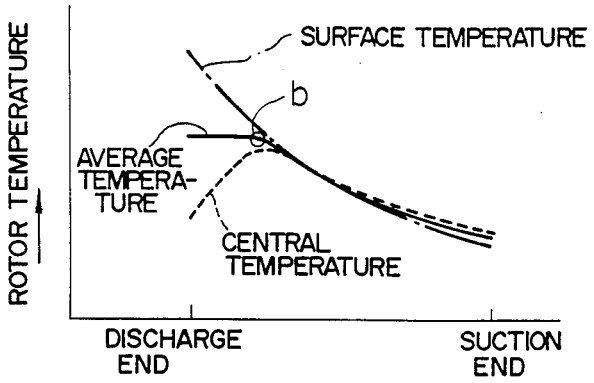
Figure 13:
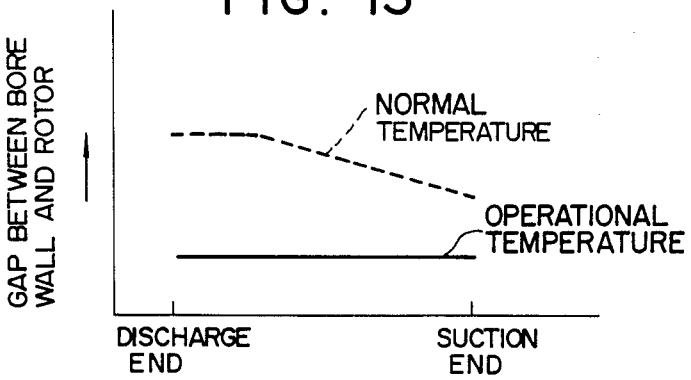

In the operation of the vacuum pump in which the discharge pressure is atmospheric pressure, the temperature of discharged gas abruptly increases after the compressing chamber 57 is communicated with the atmosphere. In this case, the pump is heated more locally compared with the compressor, and the heat capacity is small. As a result, the distribution of the temperature of the rotor becomes such as shown in FIG. 12. That is, thermal expansion of a portion of the rotor is large between the discharge end 62 and the point b, and gradually decreases as it approaches the suction end 63 from the point b. The male and female rotors 43 and 45 thermally expand in accordance with this temperature distribution, so that the gap between the bore wall 8 and the rotor during the operation is made uniform over a range between the discharge end 62 and the suction end 63 to remarkably improve the vacuum pump performance. In FIG. 13, the broken line represents the gap between the bore wall 8 and the rotor at normal temperature, and the solid line represents the rotor gap during operation.

Figure 14:
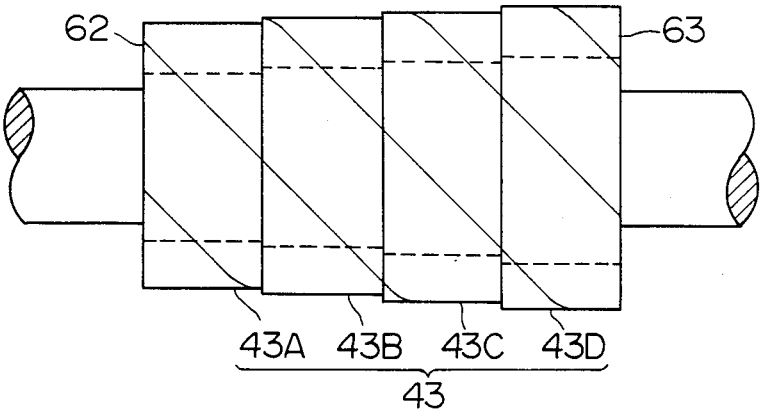
FIG. 14 is a schematic front view of a screw vacuum pump which represents a fifth embodiment of the present invention.
Figure 15:
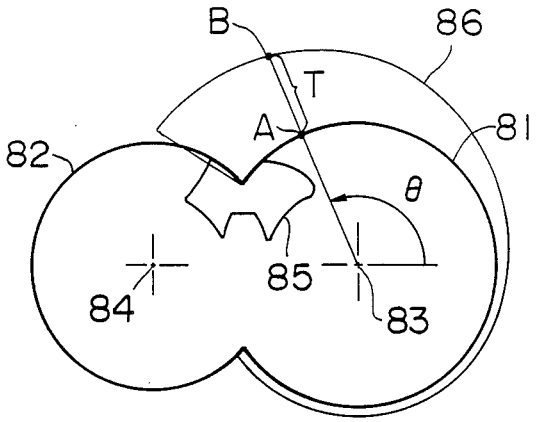
FIG. 15 PRIOR ART
FIGS. 15 to 17 illustrate a conventional machine.
Figure 16:
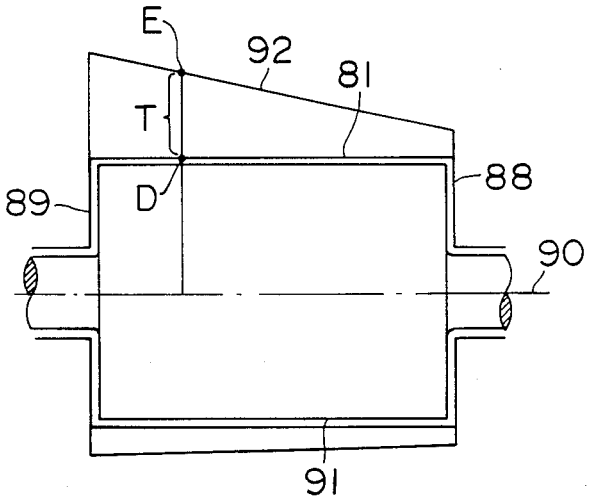
FIG. 16 PRIOR ART
Figure 17:
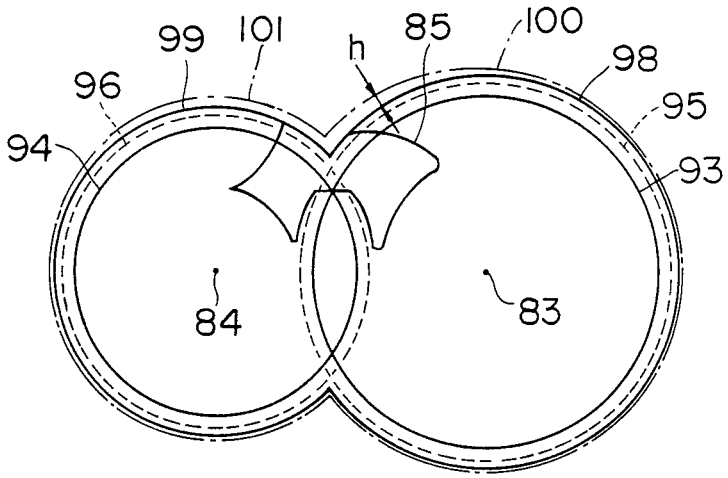
FIG. 17 PRIOR ART

FIG. 14 illustrates a fifth embodiment of the present invention, which differs from the fourth embodiment in that the male rotor 43 is divided into, for example, sections 43A, 43B, 43C and 43D between the discharge end 62 and the suction end 63 in such a manner that diameter of a portion in each divided section is made constant and is successively increased every sections starting from the high-pressure end surface 35 to the low-pressure end surface 36. If the diameter of each divided section is made constant in this manner, the male rotor 43 can be worked easily. Other constructions and functions are substantially the same as those of the fourth embodiment.

What is claimed is:

1. A screw fluid machine comprising male and female rotors adapted to rotate about two parallel axes while engaging with each other, and a casing having a pair of bore walls with a low-pressure port and a high-pressure port, said bore walls intersecting with each other and respectively accommodating said male and female rotors, wherein, at a normal temperature, in a plane perpendicular to the axes of said male and female rotors, a distance between a point on an inner surface of at least one of said bore walls and a corresponding one of said axes of said male and female rotors decreases corresponding to a bore surface displacement in a radial direction under operating conditions as the point is traced along the inner surface in a circumferential direction of said bore walls in a region where said at least one of said bore walls faces grooves of said one corresponding rotor under high pressure, and a shape of said at least one of said bore walls during operating conditions becomes a more exact circle in a plane perpendicular to the rotor axis.

2. A screw fluid machine according to claim 1, wherein at least one of said bore walls is divided into at least two sections in the direction of said axes of said male and female rotors at least in the velocity of said highpressure port, wherein, at the normal temperature, the distance between a point on an inner surface of said at least one of said bore walls in each of said divided sections and a corresponding one of said axes is constant, and wherein, at the normal temperature, said distance is smaller at a position on one of said divided sections nearer to the high-pressure side than it is at a position in the adjoining section nearer to the lowpressure side.

3. A screw fluid machine according to claim 1, wherein at least one of said bore walls is divided into at least two sections in the direction of said axes of said male and female rotors at least in the vicinity of said highpressure port by a plane perpendicular to said axes, wherein, at the normal temperature, each of said divided sections is constituted by a set of circles having constant radii and centers, and wherein, at the normal temperature, the centers of said circles deviate from a corresponding one of said axes of said male and female rotors in the direction reverse to that of said high-pressure port, the eccentricity of each circle in one of said divided sections nearer to the high-pressure side is larger than that of each circle of the adjoining section nearer to the low-pressure side.

4. A screw fluid machine according to claim 1, wherein in a plane containing said axis of said male rotor on the male rotor side and in a plane containing said axis of said female rotor on the female rotor side the distance between a point on the at least one of said bore walls and a corresponding one of said axes of said male and female rotors decreases corresponding to the bore surface displacement in the radial direction under operating conditions at a normal temperature at least on the vicinity of said high-pressure port as said point proceeds in an axial direction of said bore walls from a low-pressure end surface of said at least one of said bore walls to a high-pressure end surface of the same in the region where said at least one of said bore walls faces the grooves.

5. A screw fluid machine comprising male and female rotors adapted to rotate about two parallel axes while engaging with each other, and a casing having a pair of bore walls with a low pressure port and a high pressure port, said bore walls intersecting with each other and respectively accommodating said male and female rotors, wherein, at a normal temperature, said male and female rotor is divided into at least two sections between at least one of a discharge end and a suction end, a diameter of said male rotor being constant within at least one of said divided sections, and the diameter of said male rotor being tapered to increase within the other one of said divided sections in a direction from the discharge end to the suction end, and wherein a gap is provided between said male rotor and corresponding one of said bore walls, said gap having, at a normal temperature, a constant portion and a decreasing portion and, at an operational temperature, the gap is substantially constant from the discharge end to the suction end.

* * * * *